US009885369B2

(12) United States Patent
Ress, Jr.

(10) Patent No.: US 9,885,369 B2
(45) Date of Patent: Feb. 6, 2018

(54) VARIABLE VANE FOR GAS TURBINE ENGINE

(71) Applicant: Rolls-Royce North American Technologies, Inc., Indianapolis, IN (US)

(72) Inventor: Robert A. Ress, Jr., Carmel, IN (US)

(73) Assignee: ROLLS-ROYCE NORTH AMERICAN TECHNOLOGIES, INC., Indianapolis, IN (US)

( * ) Notice: Subject to any disclaimer, the term of this patent is extended or adjusted under 35 U.S.C. 154(b) by 30 days.

(21) Appl. No.: 15/017,277

(22) Filed: Feb. 5, 2016

(65) Prior Publication Data

US 2016/0153466 A1 Jun. 2, 2016

Related U.S. Application Data

(63) Continuation of application No. 13/340,983, filed on Dec. 30, 2011, now Pat. No. 9,309,778.

(Continued)

(51) Int. Cl.

| | |
|---|---|
| ***F04D 29/56*** | (2006.01) |
| ***F01D 17/14*** | (2006.01) |
| ***F01D 17/16*** | (2006.01) |

(52) U.S. Cl.

CPC ..... *F04D 29/563* (2013.01); *F01D 17/14* (2013.01); *F01D 17/162* (2013.01); *F05D 2220/32* (2013.01); *F05D 2240/12* (2013.01)

(58) Field of Classification Search

CPC ..... F01D 17/162; F01D 9/042; F01D 11/005; F04D 29/563; F05D 2260/79

See application file for complete search history.

(56) References Cited

U.S. PATENT DOCUMENTS 2,388,208 A * 10/1945 Foss ..... F01D 17/162 123/41.58

2,671,634 A 3/1954 Morley (Continued)

FOREIGN PATENT DOCUMENTS

EP 1715201 A2 10/2006

OTHER PUBLICATIONS

International Search Report and Written Opinion, dated Apr. 25, 2012, for International Application No. PCT/US2011/068061, Applicant, Rolls-Royce North America Technologies, Inc. (10 pages).

(Continued)

*Primary Examiner* — Woody Lee, Jr.
*Assistant Examiner* — Jesse Prager
(74) *Attorney, Agent, or Firm* — McCracken & Gillen LLC

(57) ABSTRACT

A turbomachine includes a vane, a rotation support coupled to an end of the vane, and a spindle coupled to the rotation support. The spindle, the vane, and the rotation support are rotationally aligned. An annular sleeve defines the spindle. The annular sleeve contacts the rotation support at a radially inward extent and contacts a turbine casing at a radially outward extent. A first rolling element engages the annular sleeve substantially near the radially outward extent. The first rolling element is coupled to the turbine casing. A second rolling element engages the annular sleeve substantially near the radially inward extent. The second rolling element is coupled to an outer endwall ring. A center of mass of the annular sleeve is positioned between the first and second rolling elements.

20 Claims, 3 Drawing Sheets

Related U.S. Application Data

(60) Provisional application No. 61/428,768, filed on Dec. 30, 2010.

(56) References Cited

U.S. PATENT DOCUMENTS

| | | | |
|---|---|---|---|
| 3,224,194 | A | 12/1965 | De Feo et al. |
| 3,325,087 | A | 6/1967 | Davis |
| 3,542,484 | A | 11/1970 | Mason |
| 3,966,352 | A | 6/1976 | White et al. |
| 3,990,810 | A | 11/1976 | Amos et al. |
| 3,999,883 | A | 12/1976 | Nordenson |
| 4,025,227 | A | 5/1977 | Greenberg et al. |
| 4,150,915 | A | 4/1979 | Karstensen |
| 4,169,692 | A | 10/1979 | McDonough et al. |
| 4,214,851 | A | 7/1980 | Tuley et al. |
| 4,214,852 | A | 7/1980 | Tuley et al. |
| 4,314,791 | A | 2/1982 | Weiler |
| 4,455,121 | A | 6/1984 | Jen |
| 4,679,400 | A | 7/1987 | Kelm et al. |
| 5,308,226 | A | 5/1994 | Venkatasubbu et al. |
| 5,593,275 | A | 1/1997 | Venkatasubbu et al. |
| 6,709,231 | B2 | 3/2004 | Schipani et al. |
| 7,112,040 | B2 | 9/2006 | Debeneix et al. |
| 2004/0240989 | A1 | 12/2004 | Willshee et al. |
| 2006/0029494 | A1 | 2/2006 | Bruce et al. |
| 2008/0292451 | A1 | 11/2008 | Evans et al. |
| 2009/0274547 | A1 | 11/2009 | Jahns |
| 2010/0266389 | A1 | 10/2010 | Cloarec |

OTHER PUBLICATIONS

Extended European Search Report for counterpart European Patent Application No. 11853322.3 dated Aug. 3, 2017, Applicant, Rolls-Royce North American Technologies, Inc. (8 pages).

* cited by examiner

VARIABLE VANE FOR GAS TURBINE ENGINE

CROSS REFERENCE TO RELATED APPLICATIONS

This application is a continuation of U.S. patent application Ser. No. 13/340,983, filed Dec. 30, 2011, entitled "Variable Vane for Gas Turbine Engine", which claims the benefit of provisional U.S. Patent Application No. 61/428,768 filed Dec. 30, 2010. All of the above listed applications are hereby incorporated by reference herein in their entireties.

REFERENCE REGARDING FEDERALLY SPONSORED RESEARCH OR DEVELOPMENT

The present inventions were made with U.S. Government support under contract number F33615-03-D-2357 DO0010 awarded by the United States Air Force. The United States Government may have certain rights in the present application.

BACKGROUND

The present invention relates generally to turbomachinery. The present invention more particularly but not exclusively relates to turbine engines having variable vanes. Many turbine engines include axial compressors and/or turbines with staged rotors and stators. In some circumstances, it is desirable to have stator vanes that can change orientation, for example by rotating the vanes. Vanes are sometimes rotated by fixing a cantilever to a shaft, or spindle, which is attached to the vane. The spindle experiences torsional, compressive, and bending stresses, and often at a high material temperature. The combinations of stress on the spindle can reduce reliability and/or durability, or require a more expensive or robust spindle than would be required in a simpler stress environment. Accordingly, there is a demand for further improvements in this area of technology.

SUMMARY

According to a first aspect, a turbomachine includes a vane, a rotation support coupled to an end of the vane, and a spindle coupled to the rotation support. The spindle, the vane, and the rotation support are rotationally aligned. An annular sleeve defines the spindle. The annular sleeve contacts the rotation support at a radially inward extent and contacts a turbine casing at a radially outward extent. A first rolling element engages the annular sleeve substantially near the radially outward extent. The first rolling element is coupled to the turbine casing. A second rolling element engages the annular sleeve substantially near the radially inward extent. The second rolling element is coupled to an outer endwall ring. A center of mass of the annular sleeve is positioned between the first and second rolling elements.

According to another aspect, a method includes providing a turbomachine comprising a vane, a rotation support coupled to an end of the vane, and a stem coupled to the rotation support. The stem, the vane, and the rotation support are rotationally aligned. The turbomachine further comprises an annular sleeve defining the stem. The annular sleeve contacts the rotation support at a radially inward extent and contacts a turbine casing at a radially outward extent. The turbomachine further comprises a first rolling element engaging the annular sleeve substantially near the radially outward extent. The first rolling element is coupled to the turbine casing. The turbomachine further comprises a second rolling element engaging the annular sleeve substantially near the radially inward extent. The second rolling element is coupled to an outer endwall ring. A center of mass of the annular sleeve is positioned between the first and second rolling elements. The turbomachine further comprises a cantilever affixed to an end of the stem opposite the rotation support, wherein the cantilever is structured to translate rotational force to the stem. The method further includes rotating the cantilever to control a rotational position of the vane.

According to yet another aspect, an apparatus includes a turbomachine that includes at least one compression stage and at least one vane. A vane outer button is coupled to a radially outward end of the vane. A spindle is coupled to the vane outer button. The spindle, the vane, and the vane outer button are rotationally aligned. An annular sleeve defines the spindle. The annular sleeve contacts the vane outer button at a radially inward extent and contacts a turbine casing at a radially outward extent. A first rolling element engages the annular sleeve substantially near the radially outward extent. The first rolling element is coupled to the turbine casing. A second rolling element engages the annular sleeve substantially near the radially inward extent. The second rolling element is coupled to an outer endwall ring. A center of mass of a system of the annular sleeve and the spindle is positioned between the first and second rolling elements.

DETAILED DESCRIPTION

Figure 1:
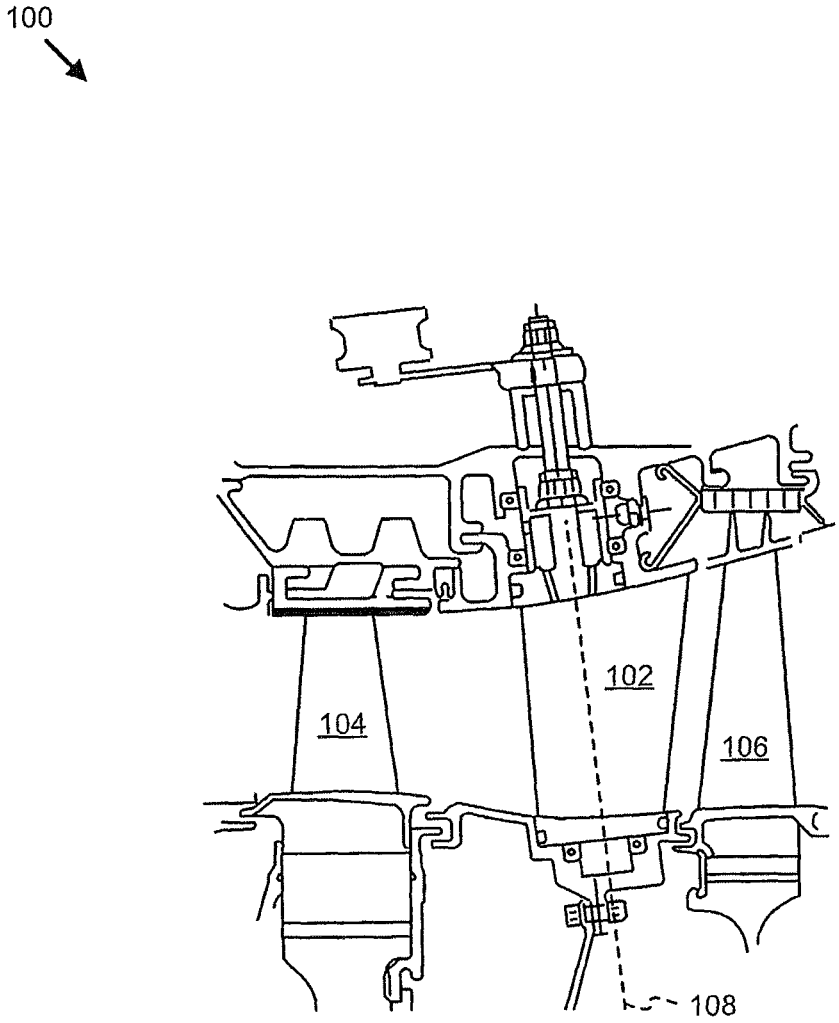
FIG. 1 is a schematic diagram of a portion of a turbomachine.

For the purposes of promoting an understanding of the principles of the invention, reference will now be made to the embodiments illustrated in the drawings and specific language will be used to describe the same. It will nevertheless be understood that no limitation of the scope of the invention is thereby intended, and any alterations and further modifications in the illustrated embodiments, and any further applications of the principles of the invention as illustrated therein as would normally occur to one skilled in the art to which the invention relates are contemplated and protected.

FIG. 1 is a schematic diagram of a portion of a turbomachine 100, which may be included as part of a gas turbine engine. The turbomachine 100 includes at least one turbine stage and at least one vane 102. In the illustration of FIG. 1, a first rotor 104 is of a high pressure turbine (HPT), and a second rotor 106 is a part of a low pressure turbine (LPT). In the embodiment of FIG. 1, the vane 102 is a variably positioned vane able to rotate about an axis 108. The vane 102 may be one of a multiplicity of vanes on a stator stage following a rotor stage, and the turbomachine 100 may include stages. In one embodiment, a vane 102 may also be located in front of the high pressure turbine. In further embodiments, the vane 102 can be used in a compressor of a gas turbine engine. Further details of certain embodiments are described in greater detail in the section referencing FIG. 2.

Figure 2:
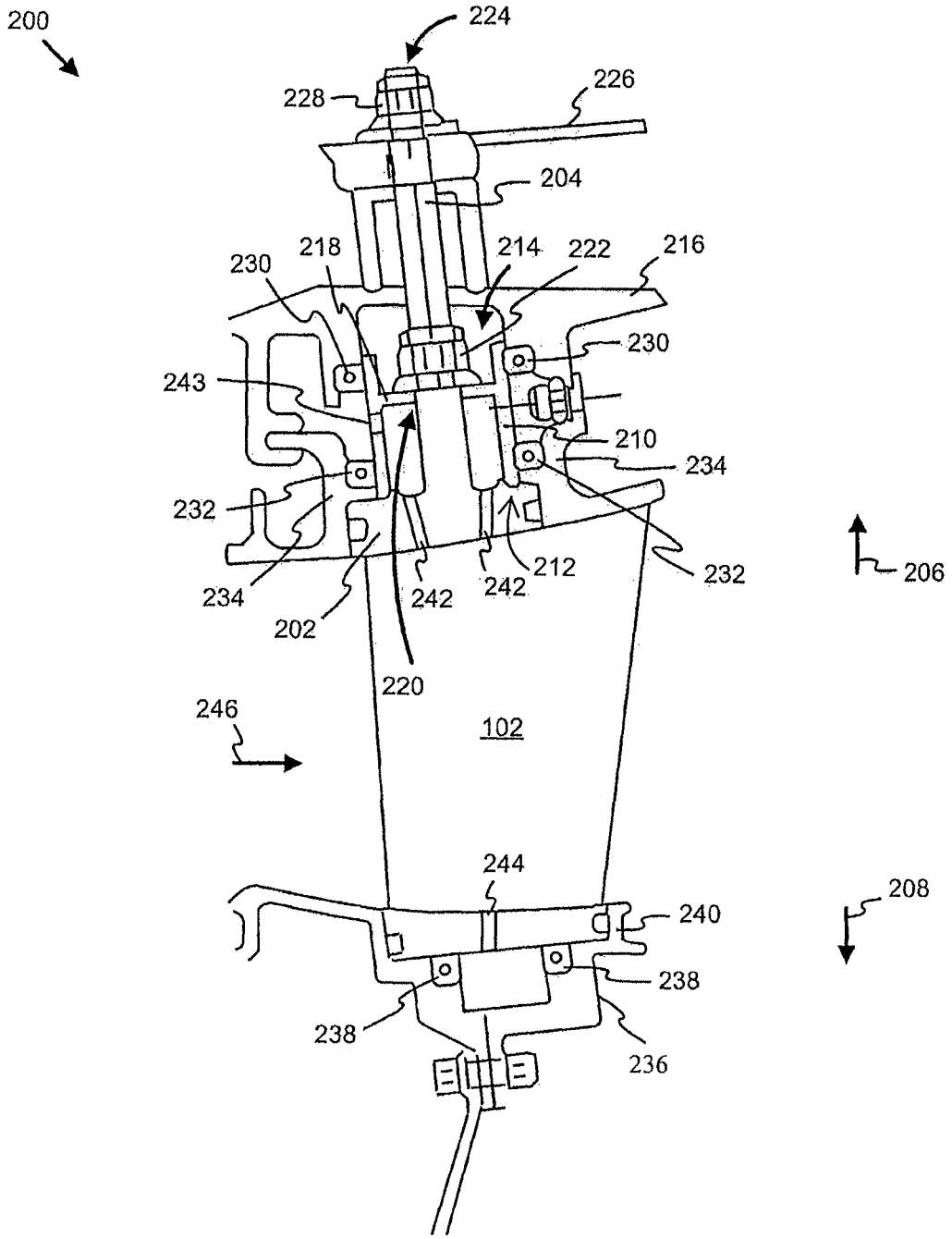
FIG. 2 is a schematic diagram of an apparatus including a variable vane.

FIG. 2 is a schematic diagram of an apparatus 200 including a variable vane 102. In certain embodiments, the apparatus 200 includes a vane outer button 202 coupled to the vane 102. In certain embodiments, the vane outer button 202 is coupled to a radially outward 206 end of the vane 102. Radially outward 206, as used herein, refers to the radial direction relative to a radial center (not shown) of a turbomachine 100 including the apparatus 200, where radially inward 208 is a direction toward the radial center and radially outward 206 is a direction away from the radial center. The vane outer button 202 may be a rotating support for a stem (e.g. a spindle 204) coupled to the vane outer button 202 and rotationally fixed to the vane 102. In certain embodiments, the spindle 204 is any component fixed to the vane 102 in a manner such that when the spindle 204 is rotated a known degree of rotation the vane 102 also rotates a similar amount of rotation. In certain embodiments, the spindle 204 and vane 102 rotate together through an identical angle of rotation, although any fixed relationship between the rotation angles is contemplated herein.

In certain embodiments, an annular sleeve 210 engages the vane outer button 202 at a first end 212, and the annular sleeve 210 engages the spindle 204 at a second end 214. An end of the annular sleeve 210 as used herein includes any location of interest on the annular sleeve 210 at, near, and/or facing a geometric end. For example, the annular sleeve 210 in FIG. 2 includes a first end 212 engaging the vane outer button 202, and a second end 214 engaging the spindle 204, where the second end 214 also engages a turbine casing 216. In certain embodiments, the annular sleeve 210 contacts the vane outer button 202 at a radially inward 208 extent of the annular sleeve 210 as shown in FIG. 2. In certain embodiments, the annular sleeve 210 contacts the turbine casing 216 at a radially outward 206 extent of the annular sleeve 210 as shown in FIG. 2.

In certain embodiments, the annular sleeve 210 includes a cross-sectional wall portion 218 having an aperture 220, and the annular sleeve 210 engages the spindle 204 where the spindle 204 extends through the aperture 220. In certain embodiments, a nut 222 engages the annular sleeve 210 with the spindle 204. For example, the nut 222 engages threads on the spindle 204 and applies force to the wall portion 218 toward the radially inward 208 extent of the annular sleeve 210. In certain embodiments, the wall portion 218 is perpendicular to the spindle 204, although other configurations of the wall portion 218 may be utilized.

In certain embodiments, the spindle 204 includes a radially outward end 224 that extends through the turbine casing 216, and a cantilever rotation actuator 226 is coupled to the radially outward end 224 of the spindle 204. In certain embodiments, the cantilever 226 is affixed to the spindle 204, for example by a nut 228 holding the cantilever 226 against the turbine casing 216. In certain embodiments, the cantilever 226 translates rotational force to the spindle 204.

In certain embodiments, the apparatus 200 includes a first bearing 230 coupled to the turbine casing 216 and a second bearing 232 coupled to an endwall outer ring 234. In certain embodiments, the first bearing 230 and second bearing 232 rotatably engage the annular sleeve 210.

In certain further embodiments, the apparatus 200 further includes an inboard rotating support, which may be a vane inner button 236, coupled to the vane 102, and a third bearing 238 coupled to an endwall inner ring 240. The third bearing 238 rotatably engages the vane inner button 236. The vane inner button 236, in certain embodiments, is coupled to the vane 102 at a radially inward portion of the vane 102. The endwall inner ring 240 may be split as shown in the illustration of FIG. 2, although the endwall inner ring 240 may be configured in any manner including, without limitation, not-split, and integral.

In certain further embodiments, the bearings 230, 232, 238 may be roller element bearings, and the roller elements may further include ceramic roller elements. In certain embodiments, the roller elements do not require lubrication. In certain embodiments, the first bearing 230 includes a rolling element engaging the annular sleeve substantially near the radially outward 206 extent of the annular sleeve, and the second bearing 232 includes a rolling element engaging the annular sleeve substantially near the radially inward 208 extent of the annular sleeve. As used herein, substantially near the radially outward 206 and radially inward 208 extent includes embodiments wherein the bearings 230, 232 are placed at a maximal distance apart as allowed by space constraints, but also includes embodiments wherein a center of mass of the annular sleeve 210 or a center of mass of the system of the annular sleeve 210 and spindle 204 is positioned between the bearings 230, 232. In certain embodiments, the apparatus 200 includes at least two bearings 230, 232 that engage the annular sleeve 210 and at least one bearing 238 that engages the vane inner button 236.

In certain embodiments, the annular sleeve 210 includes an annular sleeve wall aperture 243 that allows cooling fluid, such as but not limited to a cooling air, to enter the annular sleeve 210. For ease of convenience below, the cooling fluid may be referred to as a cooling air but no limitation is intended of the cooling fluid to be limited to an air composition. The apparatus 200 may further include at least one opening 242 in the vane outer button 202 that allows cooling air to continue and flow into the vane 102. The vane 102, in certain embodiments, is at least partially hollow and is structured to allow the cooling air to enter the vane 102. In certain embodiments, the cooling air flows through an opening 244 in the vane inner button 236 and out of the vane 102. In certain embodiments, the cooling air flows out of a trailing edge opening (not shown) of the vane 102 and exits the vane 102 into a flowing gas stream 246 in the turbomachine 100. The cooling air may include any type of cooling fluid, and further the flow of the cooling air may be in any direction, including from the vane inner button 236, through the vane 102, and exiting the vane 102 through the vane outer button 202. In some embodiments various structures such as the vane 102 may not be cooled by a cooling fluid.

In certain embodiments, any combination or sub-combination of the spindle 204, vane outer button 202, vane 102, and vane inner button 236 may be coupled by attachment or formed integrally. Attachment may include welding, bolting, or any other joining mechanism. In certain embodiments, the vane outer button 202 is integrally formed with at least one of the spindle 204, the annular sleeve 210, and the vane 102.

Figure 3:
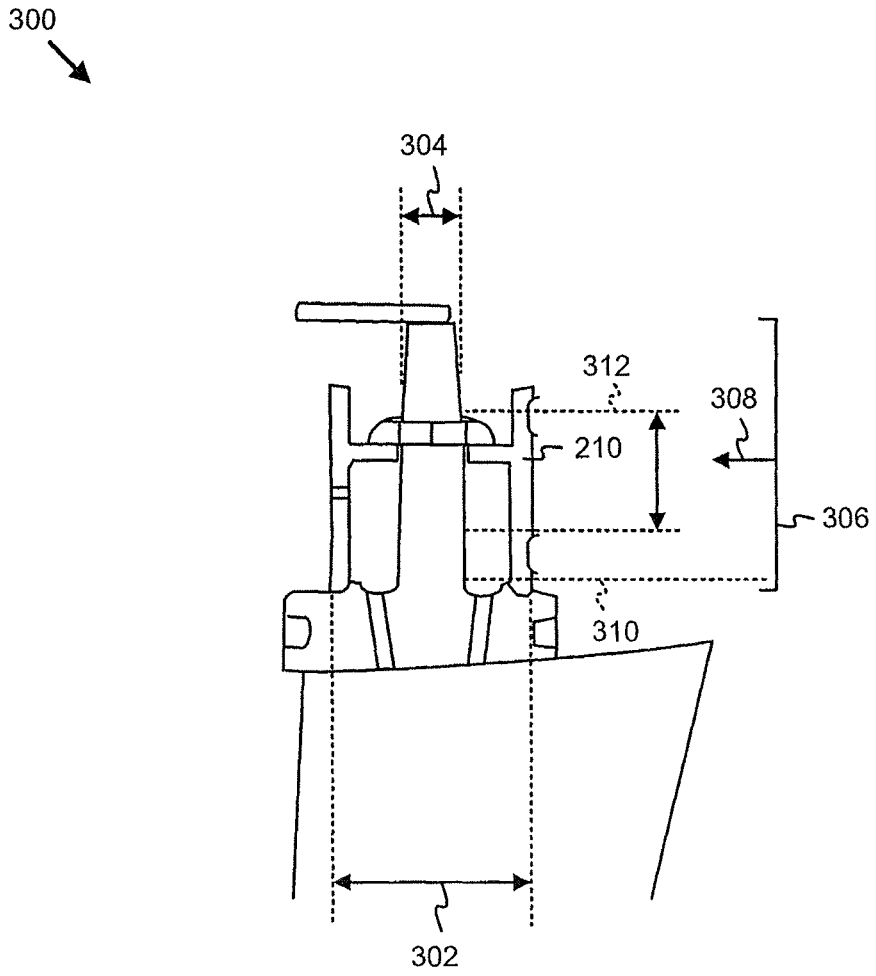
FIG. 3 is a schematic diagram of a spindle, vane outer button, and annular sleeve.

FIG. 3 is a schematic diagram of a portion of an apparatus 300 including a spindle 204, a vane outer button 202, and an annular sleeve 210. The annular sleeve 210 has an outer diameter 302 that is greater than a spindle diameter 304. In certain embodiments, the outer diameter 302 is much greater than the spindle diameter 304. In certain embodiments, the outer diameter 302 is approximately equal to a perpendicularly projected diameter of the vane outer button 202 as illustrated in FIG. 3. In certain embodiments, the outer diameter 302 is at least two times greater, and in certain further embodiments at least three times greater, than the spindle diameter 304.

In certain embodiments, the spindle 204 includes an axial length 306. The spindle 204 in FIG. 3 begins at a lower position 310. In certain embodiments, the annular sleeve 210 engages the spindle 204 at about a mid-point 308 of the spindle 204. In certain embodiments, the annular sleeve 210 engages the spindle 204 at a position between 25 percent and 75 percent (between the defined positions 312) of an axial distance along the axial length 306. The engagement positions listed are examples only, and any engagement position that sufficiently reduces bending stress on the spindle 204 from the actuation of the cantilever 226 is contemplated herein. One of skill in the art, having the benefit of the disclosures herein, can readily determine engagement positions that are sufficiently separated with simple empirical testing to provide the selected stress reduction or selected durability of the spindle 204 for a particular application.

As is evident from the text and figures presented above, a variety of embodiments according to the present invention are contemplated.

An exemplary set of embodiments is an apparatus including a vane, a rotation support coupled to an end of the vane, a spindle coupled to the rotation support, wherein the spindle, the vane, and the rotation support are rotationally aligned, and an annular sleeve engaging the rotation support at a first end and engaging the spindle at a second end. The exemplary apparatus further includes an annular sleeve that engages the spindle at about a mid-point of the spindle. In certain embodiments, the apparatus includes a first bearing coupled to an endwall outer ring and a second bearing coupled to a turbine casing, where the first and second bearings rotatably engage the annular sleeve. In certain further embodiments, the first and second bearings are ceramic rolling elements. In certain embodiments, the apparatus further includes an inboard rotating support coupled to the vane, the apparatus further comprising a third bearing coupled to a split inner endwall ring, and wherein the third bearing rotatably engages the inboard rotating support.

In certain embodiments, the annular sleeve further includes a cross-sectional wall having an aperture, where the spindle extends through the aperture, and where a nut threaded on the spindle engages the annular sleeve with the spindle. In certain embodiments, the apparatus includes a cantilever affixed to an end of the spindle opposite the rotation support, where the cantilever translates rotational force to the spindle. In certain embodiments, the rotational support is integrally formed with at least one member selected from the group consisting of the spindle, the annular sleeve, and the vane. In certain embodiments, the annular sleeve has an outer diameter at least three times greater than a diameter of the spindle.

Another exemplary set of embodiments includes a turbomachine having a variably positioned vane, an outer spindle integral with a vane outer button, where the vane is coupled to the vane outer button, an annular sleeve defining the spindle, wherein the annular sleeve contacts the vane outer button at a radially inward extent and contacts a turbine casing at a radially outward extent. In certain embodiments, the annular sleeve includes a wall portion positioned perpendicular to the spindle, where the wall portion includes an aperture and the spindle extends through the aperture, and where the spindle includes threads. In certain embodiments, a nut engages the threads, where the nut applies force to the wall portion toward the radially inward extent, a radially outward end of the spindle extends through the turbine casing, and a cantilever rotation actuator is coupled to the radially outward end of the spindle. In certain embodiments, a first rolling element engages the annular sleeve substantially near the radially outward extent, where the first rolling element is coupled to the turbine casing, and a second rolling element engages the annular sleeve substantially near the radially inward extent, where the second rolling element is coupled to an outer endwall ring.

In certain embodiments, the turbomachine further includes a vane inner button coupled to the vane at a radially inward portion of the vane, a third rolling element engages the vane inner button, and the third rolling element rotatably engages the vane inner button. In certain embodiments, the turbomachine includes an annular sleeve wall aperture and a vane outer button aperture(s), where the sleeve wall aperture and the vane outer button aperture are structured to allow cooling air to enter the vane. In certain embodiments, the annular sleeve has an outer diameter at least two times greater than a diameter of the spindle.

Yet another exemplary set of embodiments is a method including an operation to provide a turbomachine. The provided turbomachine includes a vane, a rotation support coupled to an end of the vane, a stem coupled to the rotation support, where the stem, the vane, and the rotation support are rotationally aligned, an annular sleeve engaging the rotation support at a first end and engaging the stem at a second end, and a cantilever affixed to an end of the stem opposite the rotation support, where the cantilever is structured to translate rotational force to the stem. The exemplary method further includes rotating the cantilever to control a rotational position of the vane.

In certain embodiments, the provided turbomachine further includes an opening formed in a sidewall of the annular sleeve and an opening(s) formed in the rotational support, where the opening formed in the rotational support is exposed to an inside of the vane, and the method further includes flowing a cooling gas stream through the opening formed in a sidewall of the annular sleeve, through the opening(s) formed in the rotational support and into the vane. A further exemplary embodiment of the method includes flowing the cooling gas stream through an opening in a trailing edge of the vane.

In certain embodiments, the turbomachine further includes a vane inner button coupled to the vane, the vane inner button having an opening exposed to the inside of the vane, and the method further includes flowing the cooling gas stream through the opening in the vane inner button. In certain embodiments, the turbomachine further includes a first bearing coupled to an endwall outer ring and a second bearing coupled to a turbine casing, where the first and second bearings rotatably engage the annular sleeve. In certain further embodiments, the turbomachine further includes an inboard rotating support coupled to the vane and a third bearing coupled to a split inner endwall ring, and the third bearing rotatably engages the inboard rotating support. In certain embodiments, the annular sleeve includes an outer diameter at least two times greater than a diameter of the stem.

Yet another exemplary set of embodiments is an apparatus including a turbomachine having at least one compression stage and at least one vane, a vane outer button coupled to a radially outward end of the vane, a spindle coupled to the vane outer button, wherein the spindle, the vane, and the vane outer button are rotationally aligned, and an annular sleeve engaging the vane outer button at a first end and the spindle at a second end. In certain embodiments, the apparatus further includes annular sleeve having an outer diameter that is much greater than a diameter of the spindle, and/or the annular sleeve having an outer diameter that is at least three times greater than a diameter of the spindle.

In certain embodiments, the spindle includes an axial length, and the annular sleeve engages the spindle at a position between 25 percent and 75 percent of an axial distance along the axial length. In certain embodiments, the annular sleeve includes a cross-sectional wall portion having an aperture, and the annular sleeve engages the spindle where the spindle extends through the aperture. In certain embodiments, the vane outer button is integrally formed with the spindle, the annular sleeve, and/or the vane. In certain embodiments, the apparatus further includes at least two rotating element bearings structured to engage the annular sleeve. In certain embodiments, the apparatus further includes a vane inner button coupled to a radially inward end of the vane and an inner rotating element bearing structured to engage the vane inner button.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred, more preferred or exemplary utilized in the description above indicate that the feature so described may be more desirable or characteristic, nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

The invention claimed is:

1. An apparatus, comprising:

a vane;

a rotation support coupled to an end of the vane;

a spindle coupled to the rotation support, wherein the spindle, the vane, and the rotation support are rotationally aligned;

an annular sleeve engaging the spindle, wherein the annular sleeve contacts the rotation support at a radially inward extent and contacts a turbine casing at a radially outward extent of the annular sleeve;

a first rolling element directly engaging the annular sleeve substantially near the radially outward extent, wherein the first rolling element is coupled to the turbine casing and the annular sleeve is disposed between the first rolling element and the spindle; and a second rolling element engaging the annular sleeve substantially near the radially inward extent, wherein the second rolling element is coupled to an outer endwall ring and wherein a center of mass of the annular sleeve is positioned between the first and second rolling elements.

2. The apparatus of claim 1, wherein the annular sleeve engages the spindle at about a mid-point of the spindle.

3. The apparatus of claim 1, wherein the first and second rolling elements comprise ceramic rolling elements.

4. The apparatus of claim 1, further comprising an inboard rotating support coupled to the vane, the apparatus further comprising a third rolling element coupled to a split inner endwall ring, and wherein the third rolling element rotatably engages the inboard rotating support.

5. The apparatus of claim 1, wherein the annular sleeve further comprises a cross-sectional wall having an aperture, wherein the spindle extends through the aperture, and wherein a nut threaded on the spindle engages the annular sleeve with the spindle.

6. The apparatus of claim 1, further comprising a cantilever affixed to an end of the spindle opposite the rotation support, wherein the cantilever is structured to translate rotational force to the spindle.

7. The apparatus of claim 1, wherein the rotational support is integrally formed with at least one member selected from the group consisting of the annular sleeve and the vane.

8. The apparatus of claim 1, wherein the annular sleeve has an outer diameter at least three times greater than a diameter of the spindle.

9. A method, comprising:

providing a turbomachine comprising a vane, a rotation support coupled to an end of the vane, a stem coupled to the rotation support, wherein the stem, the vane, and the rotation support are rotationally aligned, an annular sleeve engaging the stem, wherein the annular sleeve contacts the rotation support at a radially inward extent and contacts a turbine casing at a radially outward extent of the annular sleeve, a first rolling element directly engaging the annular sleeve substantially near the radially outward extent, wherein the first rolling element is coupled to the turbine casing and the annular sleeve is disposed between the first rolling element and the stem, a second rolling element engaging the annular sleeve substantially near the radially inward extent, wherein the second rolling element is coupled to an outer endwall ring and wherein a center of mass of the annular sleeve is positioned between the first and second rolling elements, a cantilever affixed to an end of the stem opposite the rotation support, wherein the cantilever is structured to translate rotational force to the stem; and rotating the cantilever to control a rotational position of the vane.

10. The method of claim 9, wherein the turbomachine further comprises an opening formed in a sidewall of the annular sleeve and at least one opening formed in the rotational support, wherein the at least one opening formed in the rotational support is exposed to an inside of the vane, the method further comprising flowing a cooling gas stream through the opening formed in a sidewall of the annular sleeve, through the at least one opening formed in the rotational support and into the vane.

11. The method of claim 10, further comprising flowing the cooling gas stream through an opening in a trailing edge of the vane.

12. The method of claim 10, the turbomachine further comprising a vane inner button coupled to the vane, the vane inner button having an opening exposed to the inside of the vane, the method further comprising flowing the cooling gas stream through the opening in the vane inner button.

13. The method of claim 9, the turbomachine further comprising an inboard rotating support coupled to the vane, and a third rolling element coupled to a split inner endwall ring, and wherein the third rolling element rotatably engages the inboard rotating support.

14. The method of claim 9, wherein the annular sleeve includes an outer diameter at least two times greater than a diameter of the stem.

15. An apparatus, comprising:

a turbomachine including at least one compression stage and at least one vane;

a vane outer button coupled to a radially outward end of the vane;

a spindle coupled to the vane outer button, wherein the spindle, the vane, and the vane outer button are rotationally aligned;

an annular sleeve engaging the spindle, wherein the annular sleeve contacts the vane outer button at a radially inward extent and contacts a turbine casing at a radially outward extent of the annular sleeve;

a first rolling element directly engaging the annular sleeve substantially near the radially outward extent, wherein the first rolling element is coupled to the turbine casing and the annular sleeve is disposed between the first rolling element and the spindle; and a second rolling element engaging the annular sleeve substantially near the radially inward extent, wherein the second rolling element is coupled to an outer endwall ring and wherein a center of mass of a system of the annular sleeve and the spindle is positioned between the first and second rolling elements.

16. The apparatus of claim 15, wherein the annular sleeve has an outer diameter that is at least three times greater than a diameter of the spindle.

17. The apparatus of claim 15, wherein the spindle includes an axial length, and wherein the annular sleeve engages the spindle at a position between 25 percent and 75 percent of an axial distance along the axial length.

18. The apparatus of claim 17, wherein the annular sleeve includes a cross-sectional wall portion having an aperture, and wherein the annular sleeve engages the spindle where the spindle extends through the aperture.

19. The apparatus of claim 15, wherein the vane outer button is integrally formed with at least one member selected from the group consisting of the spindle, the annular sleeve, and the vane.

20. The apparatus of claim 15, further comprising a vane inner button coupled to a radially inward end of the vane and an inner rolling element structured to engage the vane inner button.

* * * * *